United States Patent [19]

Henderson

[11] 3,995,741

[45] Dec. 7, 1976

[54] METHOD OF SORTING MAIL USING A CODED POSTAGE STAMP

[76] Inventor: Joseph P. W. Henderson, Rte. No. 3, Greenfield Trailer Park, Pine Bluff, Ark. 71601

[22] Filed: June 17, 1975

[21] Appl. No.: 587,688

[52] U.S. Cl. ..... 209/111.5; 209/DIG. 1; 235/61.12 N; 250/557; 283/22; 428/29; 428/199

[51] Int. Cl.[2] ..... B07C 5/34

[58] Field of Search ..... 209/111.5, 111.6, DIG. 1; 235/61.12 N; 283/6, 22, 10, 26; 250/557, 559, 566–569; 229/92–98; 428/199, 29

[56] References Cited

UNITED STATES PATENTS

| | | | |
|---|---|---|---|
| 3,652,830 | 3/1972 | Kessler | 235/61.12 N |
| 3,757,942 | 9/1973 | Gunn | 209/111.5 |
| 3,793,600 | 2/1974 | Grosbard | 235/61.12 N |

FOREIGN PATENTS OR APPLICATIONS

| | | | |
|---|---|---|---|
| 656,873 | 9/1951 | United Kingdom | 250/557 |

*Primary Examiner*—Allen N. Knowles
*Attorney, Agent, or Firm*—Clarence A. O'Brien; Harvey B. Jacobson

[57] ABSTRACT

Postage stamps selected in accordance with destination, are cancelled on mail by activating radiation which also establishes a destination code that is machine readable. The destination code is formed by a pattern of color zones on the cancelled postage stamp, the color of said zones being changed by the activating radiation.

10 Claims, 6 Drawing Figures

Fig. 1
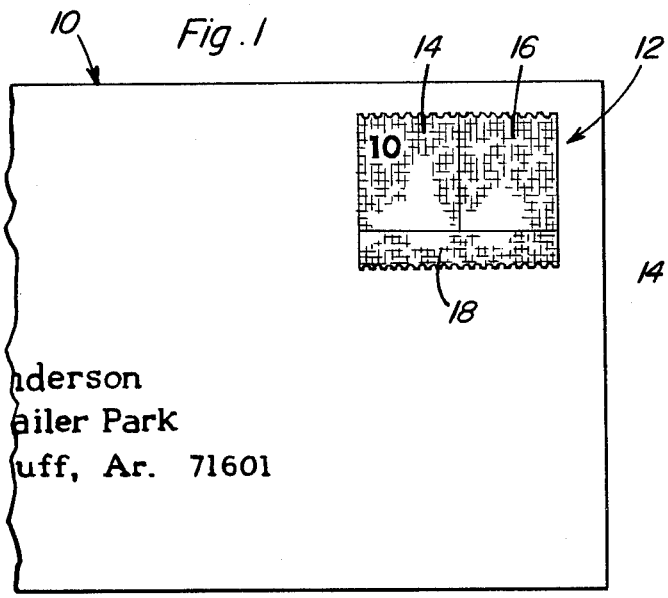
Fig. 2 (Cancelled)
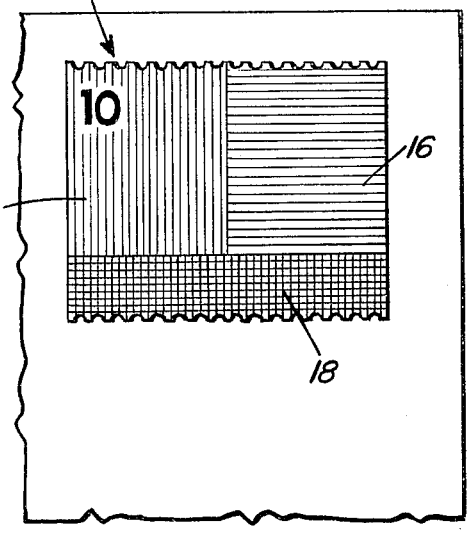
Fig. 3
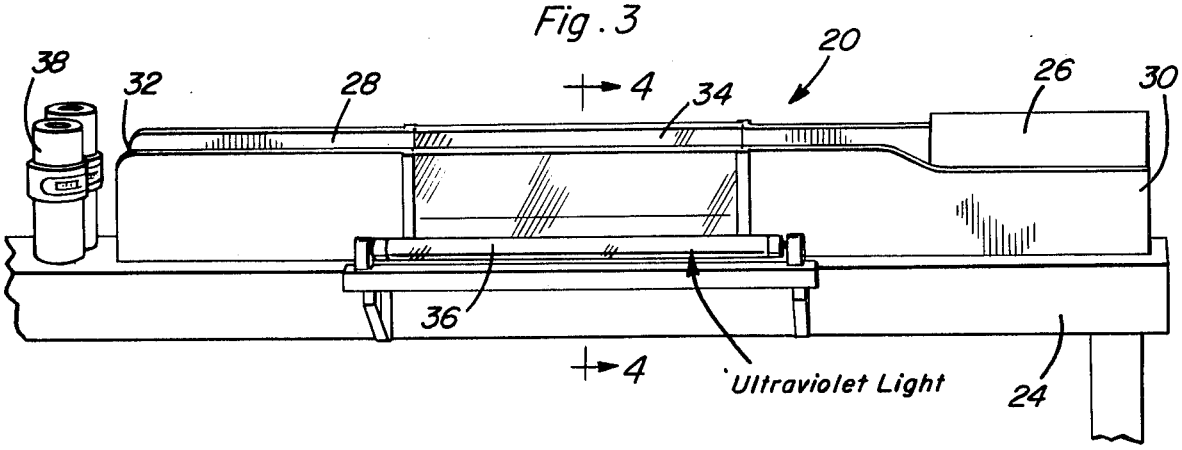
Fig. 4
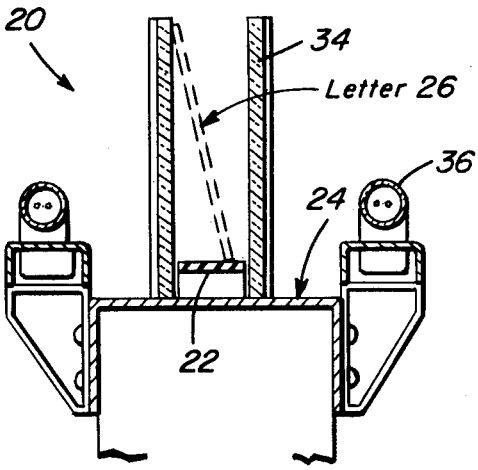
Fig. 5
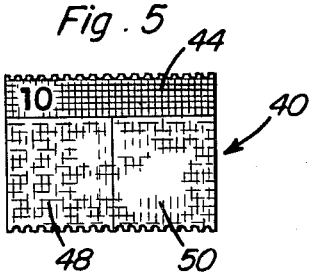
Fig. 6
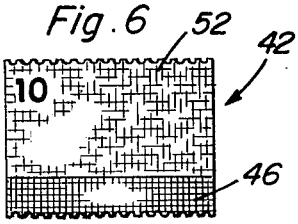

METHOD OF SORTING MAIL USING A CODED POSTAGE STAMP

BRIEF DESCRIPTION OF THE INVENTION

This invention relates to the handling of mail in general and more particularly to the coding of mail in accordance with destination.

The concept of sorting mail in accordance with destination by the sensing or detection of destination codes on the mail, is well known. The use of ultraviolet radiation to activate the code sensing apparatus is disclosed for example, in U.S. Pat. Nos. 2,609,928 to Doust and 3,105,908 to Burkhardt et al. The application of a color code directly to the postage stamp for destination coding purposes is disclosed, for example, in U.S. Pat. Nos. 3,488,511 to Mori et al and 3,745,527 to Yoshimura et al. Coding of the mail in accordance with the teachings in the foregoing patents imposes expensive requirements on the mail handling system which is often unreliable. For example, placement of the code at a predetermined location must be precise for scatter pickup. Also, specific mail and/or stamp size and travel of the mail at a given speed would be prescribed for successful operation of the foregoing mail handling systems. Further, the prior mail handling systems involving destination coding, do not eliminate other essential mail processing steps such as postal stamp cancelling. It is, therefore, an important object of the present invention to provide special types of postage stamps and a mail handling system through which the delivery of mail by the postal service may be significantly improved. An additional object is to improve the handling of mail by the postal service by reducing the amount of processing as well as the processing time.

In accordance with the present invention, pieces of mail such as letters and postcards are destination coded by the selection of the postage stamp affixed to the mail. The postage stamp while having printed matter thereon as in the past, is also treated with a radiation activated substance causing a change in color of one or more zones on the postage stamp to produce the destination code. In producing a change in color on different portions of the postage stamp, the activating radiation also cancels the stamp so that a separate cancelling step is avoided. The envelope or postcard with the cancelled stamp thereon may then be post marked in a conventional manner and conveyed through suitable color code detectors producing output signals that are processed by a computer programmed to separate the mail in accordance with destination.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 illustrates a portion of a mail addressed envelope with a postage stamp affixed thereto, the postage stamp being made and selected in accordance with the present invention.

FIG. 2 is an enlarged portion of the stamped envelope shown in FIG. 1 showing the postage stamp cancelled in accordance with the present invention.

FIG. 3 is a side elevational view of typical apparatus utilized for cancelling and post marking mail in accordance with the present invention.

FIG. 4 is a partial transverse sectional view taken substantially through a plane indicated by section line 4—4 in FIG. 3.

FIG. 5 illustrates another embodiment of a postage stamp made in accordance with the present invention.

FIG. 6 illustrates yet another embodiment of a postage stamp made in accordance with the present invention.

DESCRIPTION OF THE PREFERRED EMBODIMENT

Referring now to the drawings in detail, FIG. 1 illustrates a typical article to be mailed in the form of an addressed envelope generally referred to by reference numeral 10 having an attachment in the form of a postage stamp 12 affixed thereto. The postage stamp 12 need not be affixed to the envelope at any precise location but is shown in FIG. 1 placed at the usual upper right-hand corner portion of the envelope. The postage stamp 12 shown represents a selection made from postage stamps that are provided with a destination code. Postage stamps with different destination codes may therefore be provided and sold to the public. The destination codes may identify different geographical locations such as local mail, instate but out-of-town mail, as well as different types of mail such as airmail, special delivery and certified mail. With respect to out-of-state mail, separate destination codes may be available for each of the 50 states of the United States as well as for different foreign countries.

The destination codes are formed on the postage stamp 12 shown by example in FIG. 1 by different patterns of color zones 14, 16 and 18. Each color zone of the postage stamp may be treated or coated with a chemical substance that is activated by radiation to effect a change in color. For example, the postage stamp 12 shown in FIG. 1 may be initially colored yellow on all of the zones 14, 16 and 18. When the postage stamp is cancelled by exposure to activating radiation, as shown by the cancelled postage stamp 12' in FIG. 2, each of the zones 14, 16 and 18 undergoes a change in color to red, blue and black, for example, the foregoing combination or pattern of colors representing a selected destination code.

The treatment of sheets of paper of which postage stamps are made, with chemical substances that change color when exposed to activating radiation, are well known. Paper treated with such a substance is marketed, for example, commercially as Dupont "Dylux 503" and is referred to as an instant image-proof paper. The foregoing product reacts to change color when exposed only to ultraviolet light as the activating radiation. Therefore, in accordance with the present invention, different color zones of a postage stamp may be treated as in the case of the aforementioned Dupont product for destination coding purposes. The activating radiation or ultraviolet light producing a change in color in each of the color zones will not only produce a destination code that is machine readable but will also effectively cancel the stamp.

FIGS. 3 and 4 illustrate apparatus for cancelling and color coding postage stamps in one step in accordance with the present invention. This apparatus generally referred to by reference numeral 20 includes a conveyor 22 supported on a frame 24 for conveying pieces of mail 26 between parallel spaced fences 28 extending from a conveyor inlet portion 30 to a delivery end portion 32. The fences 28 are opaque except along a radiation transmissive portion 34 at which ultraviolet lamps 36 are mounted on the conveyor frame 24 in order to expose both sides of the mail traveling between the fences from the inlet end portion 30 to the delivery end portion 32. The postage stamps on the mail are accordingly exposed to the activating radiation of the ultraviolet lamps in order to both cancel the stamps as aforementioned as well as to produce the destination code. After cancellation, the mail is delivered by the conveyor between the post mark applying rollers 38. Post marks may thereby be applied to the postage stamps or to any other location in a conventional manner after the stamps are cancelled and without adversely affecting the readability of the destination code.

Once the mail has been cancelled, color coded and post marked, the destination code may be machine read and the output thereof fed to a computer programmed to control the routing and separation of the mail in accordance with the coded destinations. Technology is presently available for color code reading and computer programming for the separation and routing of mail in accordance with destination codes. The postage stamps and associated method of the present invention should therefore provide for improved postal service.

FIGS. 5 and 6 illustrate other arrangements of postage stamps 40 and 42 made in accordance with the present invention. In these stamps, it will be observed that solid color zones 44 and 46 are respectively formed along the top and bottom of the stamp bordering the two different color changing zones 48 and 50 of stamp 40 and the single color changing zone 52 of stamp 42. The solid color zones 44 and 46 may constitute orientation reference zones by means of which read-out of two different color codes will not be confused by different orientations of the letter. Thus, the top and bottom of the postage stamps 40 and 42 may be recognized while the color code pattern is being sensed. It should of course, be appreciated that many different arrangements and patterns of color zones are available as well as different colors in order to form all of the desired destination codes.

It should be appreciated that the mail handling and destination coding system of the present invention will require cooperation on the part of the public in selecting the proper postage stamp. Properly coded postage stamps may accordingly be sold or dispensed from appropriately labelled storage bins. Cancelling of the stamps and the establishment of the destination codes that are machine readable, may thereafter be accomplished without any precise placement of the stamp on the letter or postcard. Further, no specific size requirements for the stamps will be imposed nor any precise traveling speed for the mail will be required for cancellation and code scanning. Also, the cancellation method accompanying the establishment of the color code, will eliminate the old cancellation method which caused many letters to be torn open or stained by ink when caught in the cancelling machine.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A method of handling mail on which a postage stamp is affixed, including the steps of: selecting a postage stamp having a destination code established by activating radiation and applying it to the mail; cancelling the postage stamp by exposure of the mail to the activating radiation producing said destination code; sensing the radiation activated destination code on the cancelled postage stamp; and routing the mail in accordance with the radiation activated destination code sensed on the cancelled postage stamp affixed thereto.

2. The method of claim 1 wherein said destination code is formed by a predetermined pattern of different color zones.

3. The method of claim 2 wherein said activating radiation is ultraviolet light.

4. The method of claim 3 including the step of: applying a post mark to the postage stamp after cancellation.

5. The method of claim 1 wherein said destination code is formed by a color changing substance on the postage stamp.

6. The method of claim 5 wherein said activating radiation is ultraviolet light.

7. The method of claim 1 wherein said activating radiation is ultraviolet light.

8. The method of claim 1 including the step of: applying a post mark to the mail after cancellation.

9. In a method of handling articles, the steps of: selecting an attachment coated with a radiation activated substance embodying a non-detectable destination code; applying said coated attachment to the article; exposing the article to activating radiation changing the coating substance on the attachment to render the destination code detectable; and reading the destination code after being rendered detectable to route the article in accordance therewith, said attachment being a postage stamp bearing printed matter and having at least one zone coated with said radiation activated substance that changes color to both cancel the stamp and render the destination code machine readable.

10. The method as defined in claim 9 wherein the postage stamp includes another coated zone establishing an orientation reference when activated.

* * * * *